United States Patent [19]

Scalzo

[11] Patent Number: 4,889,470

[45] Date of Patent: Dec. 26, 1989

[54] COMPRESSOR DIAPHRAGM ASSEMBLY

[75] Inventor: Augustine J. Scalzo, Longwood, Fla.

[73] Assignee: Westinghouse Electric Corp., Pittsburgh, Pa.

[21] Appl. No.: 226,705

[22] Filed: Aug. 1, 1988

[51] Int. Cl.[4] ..... F04D 29/54

[52] U.S. Cl. ..... 415/209.2; 415/189

[58] Field of Search ..... 415/189, 190, 216, 217, 415/218, 170 R, 172 A, 208.1, 208.2, 209.2, 209.3, 173.1

[56] References Cited

U.S. PATENT DOCUMENTS

| | | | |
|---|---|---|---|
| 2,834,537 | 5/1958 | Neary | 415/217 |
| 3,339,833 | 9/1967 | Bill et al. | 415/218 |
| 3,849,023 | 11/1974 | Klumpas | 415/172 A |
| 4,543,039 | 9/1985 | Ruis et al. | 415/190 |
| 4,741,667 | 5/1988 | Price et al. | 415/DIG. 1 |
| 4,767,267 | 8/1988 | Salt et al. | 415/170 R |

FOREIGN PATENT DOCUMENTS

| | | | |
|---|---|---|---|
| 757505 | 7/1949 | Fed. Rep. of Germany | 415/139 |
| 3341871 | 5/1985 | Fed. Rep. of Germany | 415/139 |
| 496377 | 3/1976 | U.S.S.R. | 415/190 |
| 660383 | 11/1951 | United Kingdom | 415/190 |
| 760884 | 11/1956 | United Kingdom | 415/190 |
| 780137 | 7/1957 | United Kingdom | 415/172 |
| 853314 | 11/1960 | United Kingdom | 415/172 A |

*Primary Examiner*—Robert E. Garrett
*Assistant Examiner*—John T. Kwon
*Attorney, Agent, or Firm*—K. Bach

[57] ABSTRACT

A compressor diaphragm assembly for combustion turbines includes a plurality of vane airfoils, each of which is formed with an integral inner shroud. A segmented seal carrier is suspended from the inner shrouds, and an outer ring supports the plurality of vane airfoils from a casing portion of the turbine in a parallel relationship at a predetermined angle with respect to the longitudinal axis of the turbine. The outer ring has one or more grooves formed at the predetermined angle to engagably receive respective rows of the vane airfoils at their outer portion. Each seal carrier segment includes a pair of disc-engaging seals, and is formed to be engaged with the inner shrouds of one or more vane airfoils, in order to provide a labyrinth seal with discs assembled to form a rotating shaft.

30 Claims, 5 Drawing Sheets

COMPRESSOR DIAPHRAGM ASSEMBLY

BACKGROUND OF THE INVENTION

1. Field of the Invention

This invention relates generally to combustion or gas turbines, and more particularly to the compressor diaphragm assemblies that are typically used in such turbines.

2. Statement of the Prior Art

Over two-thirds of large, industrial combustion turbines (which are also sometimes referred to as "gas turbines") are in electric-generating use. Since they are well suited for automation and remote control, combustion turbines are primarily used by electric utility companies for peak-load duty. Where additional capacity is needed quickly, where refined fuel is available at low cost, or where the turbine exhaust energy can be utilized, however, combustion turbines are also used for base-load electric generation.

In the electric-generating environment, a typical combustion turbine is comprised generally of four basic portions: (1) an inlet portion; (2) a compressor portion; (3) a combustor portion; and (4) an exhaust portion. Air entering the combustion turbine at its inlet portion is compressed adiabatically in the compressor portion, and is mixed with a fuel and heated at a constant pressure in the combustor portion, thereafter being discharged through the exhaust portion with a resulting adiabatic expansion of the gases completing the basic combustion turbine cycle which is generally referred to as the Brayton, or Joule, cycle.

As is well known, the net output of a conventional combustion turbine is the difference between the power it produces and the power absorbed by the compressor portion. Typically, about two-thirds of combustion turbine power is used to drive its compressor portion. Overall performance of the combustion turbine is, thus, very sensitive to the efficiency of its compressor portion. In order to ensure that a highly efficient, high pressure ratio is maintained, most compressor portions are of an axial flow configuration having a rotor with a plurality of rotating blades, axially disposed along a shaft, interspersed with a plurality of inner-shrouded stationary vanes providing a diaphragm assembly with stepped labyrinth interstage seals.

A significant problem of fatigue cracking in the airfoil portion of inner-shrouded vanes exists, however, due to conventionally used methods of manufacturing such vanes. For example, in either of the rolled or forged methods used by the manufacturers of most compressor diaphragm assemblies, a welding process is used to join the vane airfoils to their respective inner and outer shrouds, such process resulting in a "heat-affected zone" at each weld joint. Crack initiation due to fatigue, it has been found, more often than not occurs at such heat-affected zones. Therefore, it would be desirable not only to provide an improved compressor diaphragm assembly that would be resistant to fatigue cracking, but also to provide a method of fabricating such assemblies that would minimize processes which produce heat-affected zones.

The problems associated with fatigue cracking are not, however, resolved merely by eliminating those manufacturing processes that produce heat-affected zones. That is, it is well known that certain forged-manufactured vane airfoils, even after having been subjected to careful stress relief which reduces the effects of their heat-affected zones, can experience a fatigue cracking problem. It is, therefore, readily apparent that not only static, but also dynamic stimuli within the combustion turbine contribute to the problem of fatigue cracking.

Forces that act upon the inner shroud and seal of a compressor diaphragm assembly are due, primarily, to seal pressure drop. Those forces, as well as aerodynamic forces acting normally and tangentially upon, and distributed over the surfaces of the vane airfoil, each contribute to the generation of other forces and moments that are transferred to the outer shroud, and subsequently to the casing of the combustion turbine via the weld joints which attach the vane airfoil to the outer shroud.

It would appear that the simple alternative of using vane airfoils with integral outer and inner shrouds would quickly solve both causes of fatigue cracking. That is, the problem of heat-affected zones would appear to be eliminated entirely while the problems associated with instabilities due to static and dynamic stimuli within the combustion turbine would appear to be minimized. Such is not the case, however.

For example, under the influence of the static forces and moments described above, the outer shroud segment of this hypothetical vane airfoil would not be stably engaged within the casing of the combustion turbine until such time that a restraining moment could be generated by contact of the extremities of the outer shroud segment with the walls of the slot formed in the casing to receive the segment. The outer shroud segment would, thus, rotate within the clearance gap (provided in the casing slot to account for thermal expansion). As a result, use of the hypothetical vane airfoil in a combustion turbine would lead to a great deal of stress in the vicinity of the outer shroud segment and excessive translational and rotational displacements, each of which would be further exacerbated under dynamic stimuli. It would also be desirable, therefore, to provide an improved compressor diaphragm assembly that would avoid the above described instabilities of engagement.

SUMMARY OF THE INVENTION

Accordingly, it is a general object of the present invention to provide an improved combustion turbine. More specifically, it is an object of the present invention to provide not only an improved compressor diaphragm assembly for use in such combustion turbines, but also an improved method of fabricating such compressor diaphragm assemblies.

It is another object of the present invention is to provide a compressor diaphragm assembly that minimizes problems of fatigue cracking.

It is still another object of the present invention is to provide a method of fabricating a compressor diaphragm assembly that substantially eliminates production of heat- affected zones.

It is a further object of the present invention to provide a compressor diaphragm assembly that minimizes its instabilities of engagement with the casing of a combustion turbine due to both static and dynamic stimuli which may be experienced within the operational combustion turbine.

It is yet a further object of the present invention to provide a compressor diaphragm assembly that is readily and inexpensively manufactured by existing technology.

Briefly, these and other objects, advantages and novel features according to the present invention are provided in a combustion turbine having a compressor diaphragm assembly that includes a plurality of vane airfoils, each of which is formed with an integral inner shroud, a segmented seal carrier suspended from the inner shroud, and a segmented outer ring for supporting the plurality of vane airfoils, at a predetermined angle with respect to the longitudinal axis of the turbine, through engagement with a slot formed circumferentially in the casing of the turbine. Each of the outer ring segments has one or more grooves formed to engagably receive a respective one of the vane airfoils at its outer portion. Each seal carrier segment includes a pair of disc-engaging seals, and is formed to be engaged with the inner shrouds of one or more vane airfoils.

In accordance with one important aspect of the present invention, heat-affected zones caused by manufacture of the compressor diaphragm assembly are eliminated since the plurality of vane airfoils, with their integrally formed inner shrouds, are joined to their respective outer ring and seal carrier segments by processes which do not utilize heat. Furthermore, instabilities of engagement between the vane airfoils and the casing slot, due to both static and dynamic stimuli that may be experienced within the operational combustion turbine, are also minimized in accordance with another important aspect of the invention by forming the outer portion of each vane airfoil to engage its respective groove parallel to the predetermined angle.

The above and other objects, advantages, and novel features according to the present invention will become more apparent from the following detailed description of a preferred embodiment thereof, considered in conjunction with the accompanying drawings wherein:

DETAILED DESCRIPTION OF THE PREFERRED EMBODIMENT

Figure 1:
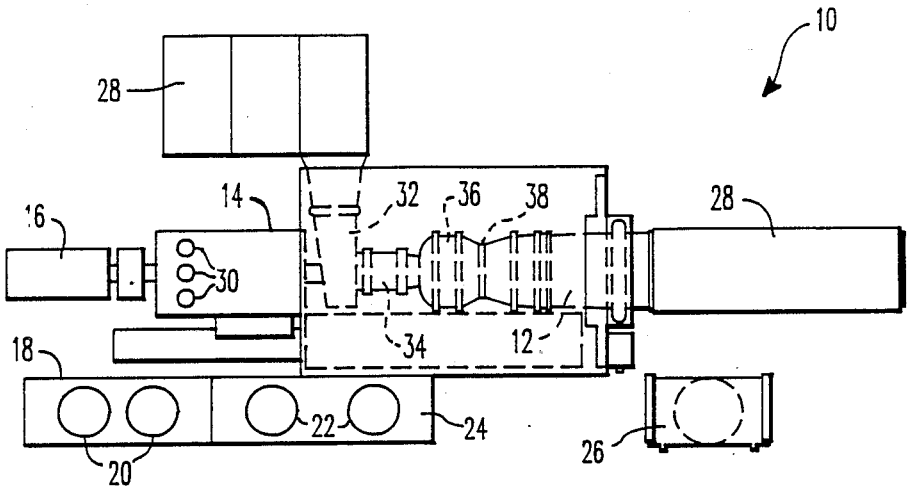
FIG. 1 is a layout of a typical electric-generating plant which utilizes a combustion turbine.

Referring now to the drawings, wherein like characters designate like or corresponding parts throughout each of the several views, there is shown in FIG. 1 the layout of a typical electric-generating plant 10 utilizing a well known combustion turbine 12 (such as the model W501D single shaft, heavy duty combustion turbine that is manufactured by the Combustion Turbine Systems Division of Westinghouse Electric Corporation). As is conventional, the plant 10 includes a generator 14 driven by the turbine 12, a starter package 16, an electrical package 18 having a glycol cooler 20, a mechanical package 22 having an oil cooler 24, and an air cooler 26, each of which support the operating turbine 12. Conventional means 28 for silencing flow noise associated with the operating turbine 12 are provided for at the inlet duct and at the exhaust stack of the plant 10, while conventional terminal means 30 are provided at the generator 14 for conducting the generated electricity therefrom.

Figure 2:
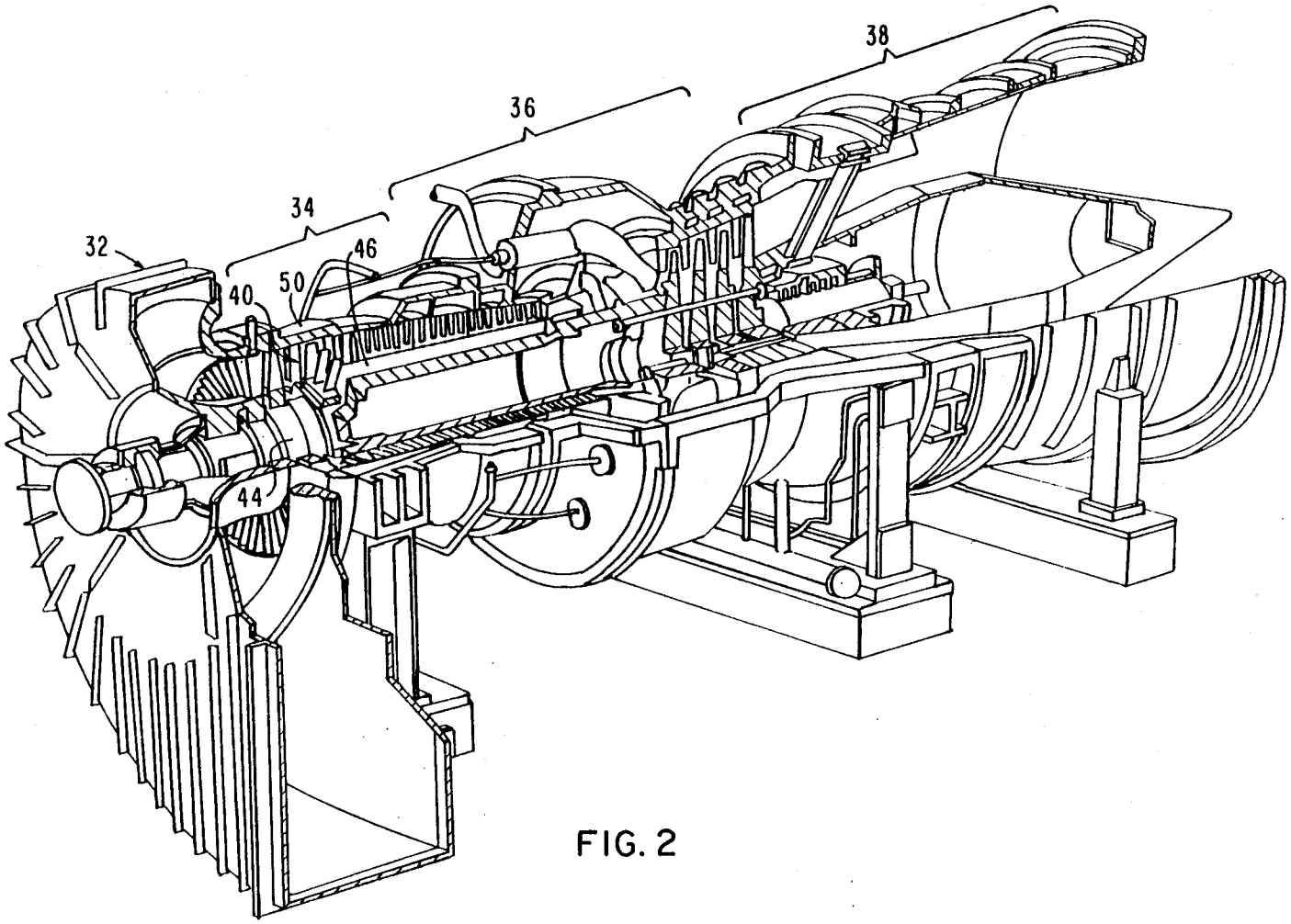
FIG. 2 is an isometric view, partly cutaway, of the combustion turbine shown in FIG. 1.

As is shown in greater detail in FIG. 2, the turbine 12 is comprised generally of an inlet portion 32, a compressor portion 34, a combustor portion 36, and an exhaust portion 38. Air entering the turbine 12 at its inlet portion 32 is compressed adiabatically in the compressor portion 34, and is mixed with a fuel and heated at a constant pressure in the combustor portion 36. The heated fuel/air gases are thereafter discharged from the combustor portion 36 through the exhaust portion 38 with a resulting adiabatic expansion of the gases completing the basic combustion turbine cycle. Such thermodynamic cycle is alternatively referred to as the Brayton, or Joule, cycle.

In order to ensure that a desirably highly efficient, high pressure ratio is maintained in the turbine 12, the compressor portion 34, like most compressor portions of conventional combustion turbines, is of an axial flow configuration having a rotor 40. The rotor 40 includes a plurality of rotating blades 42, axially disposed along a shaft 44, and a plurality of discs 46. Each adjacent pair of the plurality of rotating blades 42 is interspersed by one of a plurality of inner-shrouded stationary vanes 48, mounted to the turbine casing 50 as explained in greater detail herein below, thereby providing a diaphragm assembly in conjunction with the discs 46 with stepped labyrinth interstage seals 52.

Due to conventionally used methods of manufacturing inner-shrouded vanes 48, there exists a significant problem of fatigue cracking. For example (and referring now to FIGS. 3 and 4), in either of the methods that have been used by the manufacturers of most compressor diaphragm assemblies, a welding process is used to join an airfoil portion 54 of the inner-shrouded vane 48 to its respective inner 56 and outer shrouds 58. Such processes, as is well known, result in a heat-affected zone 60 at each weld joint 62.

As defined by the *Metals Handbook* (9th ed.), Volume 6: "Welding, Brazing, and Soldering", American Society for Metals, Metals Park, Ohio, a "heat-affected zone" is that portion of the base metal which has not been melted, but whose mechanical properties or microstructure have been altered by the heat of welding, brazing, soldering, or cutting. In stainless steels alloys of the type utilized for the airfoils 54, inner shrouds 56 and outer shrouds 58, crack initiation due to fatigue more often than not occurs at such heat-affected zones 60.

As noted above, however, problems associated with fatigue cracking are not resolved merely by eliminating those manufacturing processes that produce the heat-affected zones 58. For example, FIG. 3 illustrates an inner-shrouded vane 48 that is manufactured by the rolled constant section approach, while FIG. 4 illustrates an inner-shrouded vane 48 that is manufactured by the forged variable thickness-to-chord ratio approach.

Figure 3:
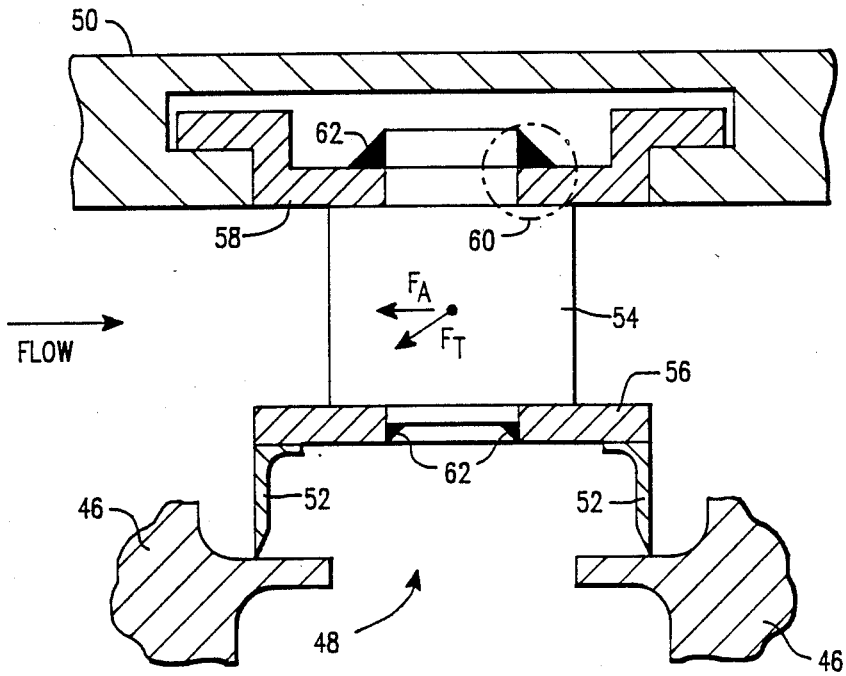
FIG. 3 illustrates the forces which impact upon an inner-shrouded vane manufactured in accordance with one prior art method.
Figure 4:
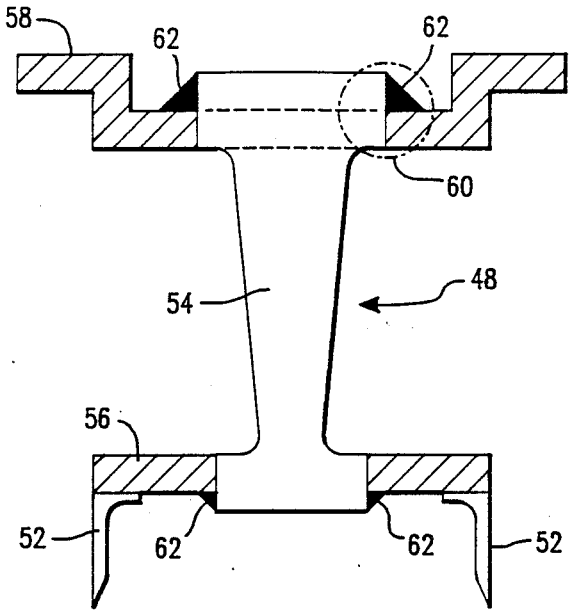
FIG. 4 shows another inner-shrouded vane manufactured in accordance with a second prior art method.

Forces that typically act upon the inner shroud 56 and its seal 52 of conventional compressor diaphragm assemblies such as those shown in FIGS. 3 and 4 are primarily due to seal pressure drop $F_S$. Those forces, as well as aerodynamic forces acting normally $F_A$ and tangentially $F_T$ upon airfoil portion 54, each contribute to the generation of other forces and moments that are transferred to the outer shroud 56, and subsequently to the casing 50 of the combustion turbine 12 via the weld joints 62 which attach the vane airfoil 54 to the outer shroud 58

Fatigue cracking, nevertheless, would still not be eliminated through use of a hypothetical airfoil having an integrally formed inner and outer shroud, thereby doing away with the heat-affected zones 60. Under the influence of the static forces and moments described above, the outer shroud segment of this hypothetical vane airfoil would not be stably engaged with the casing of the combustion turbine until such time that a restraining moment could be generated by contact of the extremities of the outer shroud segment with the walls of the slot formed in the casing to receive the segment. The outer shroud segment would, thus, rotate within the clearance gap (provided in the casing slot to account for thermal expansion). As a result, use of the hypothetical vane airfoil in a combustion turbine would lead to a great deal of stress in the vicinity of the outer shroud segment and excessive translational and rotational displacements, each of which would be further exacerbated under dynamic stimuli.

Figure 5:
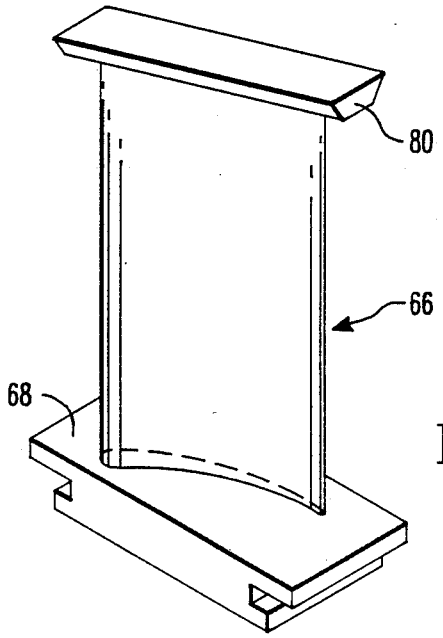
FIG. 5 is an isometric view of an inner-shrouded vane according to the present invention.
Figure 6:
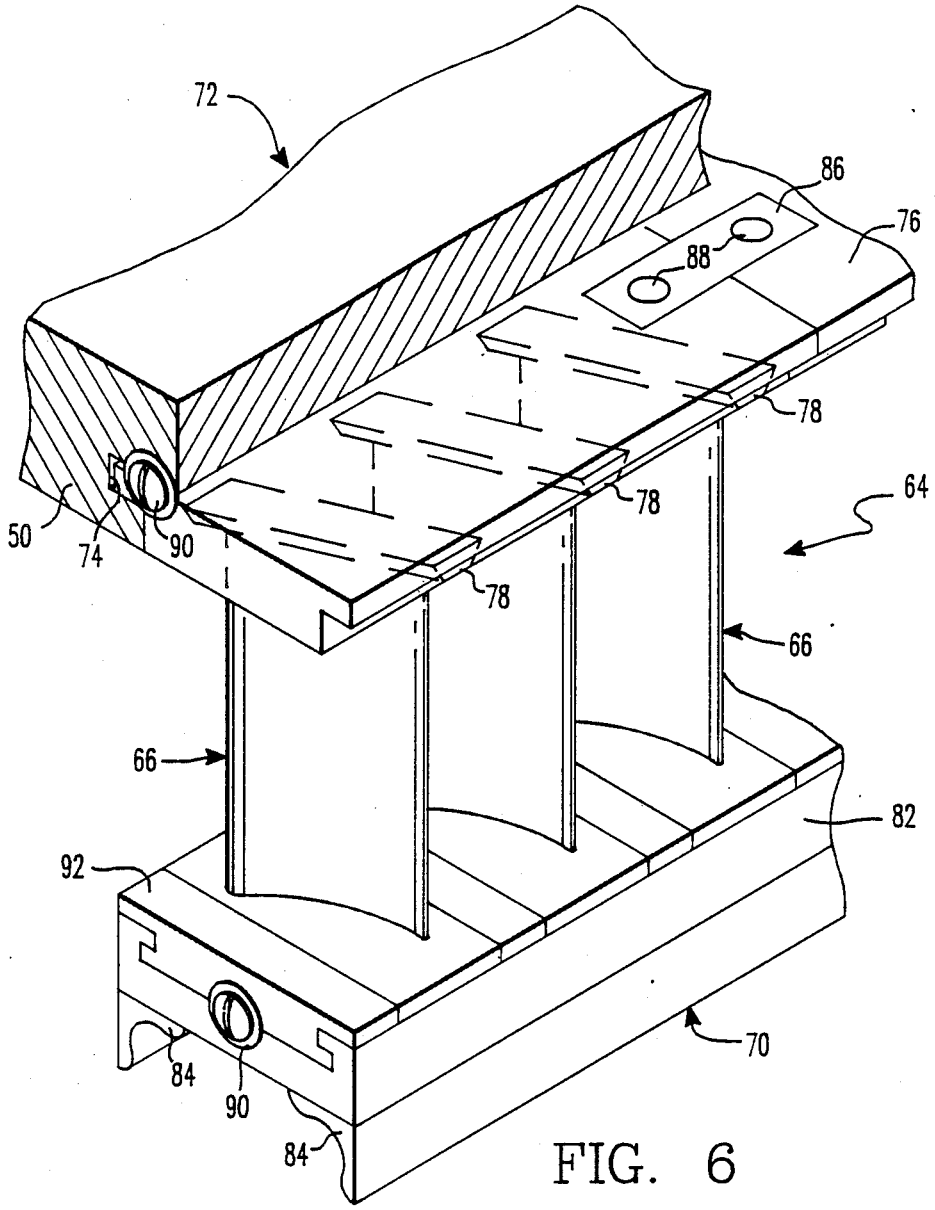
FIG. 6 depicts the inner-shrouded vane shown in FIG. 5 as assembled in accordance with a preferred embodiment of the present invention.
Figure 7:
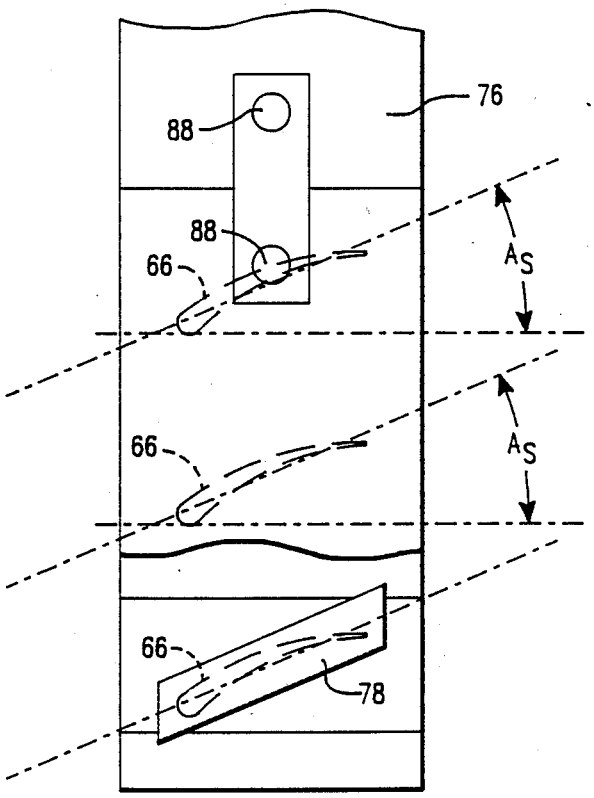
FIG. 7 is a top view of the assembly shown in FIG. 6 illustrating the predetermined angle at which the inner-shrouded vanes according to the present invention are disposed.

It has been found that a compressor diaphragm assembly 64, as shown in FIGS. 5–7, will substantially eliminate the fatigue cracking problems described herein above. As shown in FIG. 5, the compressor diaphragm assembly 64 includes a plurality of vane airfoils 66, each of which is formed with an integral inner shroud 68, a segmented seal carrier 70 suspended from the inner shroud 68, and a segmented outer ring 72 for supporting the plurality of vane airfoils 66, at a predetermined angle $A_S$ (FIG. 7) with respect to the longitudinal axis of the turbine 12, through engagement with a slot 74 formed circumferentially in the casing 50 of the turbine 12. Each of the outer ring segments 76 has one or more grooves 78 formed to engagably receive a respective one of the vane airfoils 66 at its outer portion 80. Each seal carrier segment 82 includes a pair of disc-engaging seals 84, and is formed to be engaged with the inner shrouds 68 of one or more vane airfoils 66.

In accordance with one important aspect of the present invention, heat-affected zones are eliminated since the plurality of vane airfoils 66, with their integrally formed inner shrouds 68, are joined to their respective outer ring and seal carrier segments 76, 82 by processes which do not utilize heat. Furthermore, there are few if any instabilities of engagement between the vane airfoils 66 and the casing slot 74 (due either to static or dynamic stimuli) since the outer portion 80 of each vane airfoil 66 is formed to engage its respective groove 78 parallel to the predetermined angle $A_S$.

The predetermined angle $A_S$, generally referred to as the "stagger angle", is the angle at which each of the vane airfoils 66 are aligned relative to the longitudinal axis of the turbine 12. That is, and referring for the moment to FIG. 7 in conjunction with FIG. 5, the outer portion 80 of the vane airfoil 66 is rotated until it is parallel to the stagger angle, and thus, perpendicular to the forces generated by $F_T$. The outer portion 80 thereby engages a slot 78 formed in an outer ring segment 76 at this stagger angle $A_S$, causing the distribution of normal forces acting on the outer portion 80 to be more uniform. This, in combination with 0.001-inch clearances typical of rotor blades, provides a stable restraint system with minimum displacements and rotations of the vane airfoils 66.

Referring again to FIG. 6, it can be seen that a plurality of the vane airfoils 66 are assembled into the outer ring segments 76 by inserting their respective outer portions 80 into the grooves 78 formed in the outer ring segments 76. As such, the vane airfoils 66 and especially their outer portions 80 are aligned optimally parallel to the stagger angle $A_S$. While each of the outer portions 80 are shown having a generally triangular shaped cross-section, it should be noted at this juncture that any such cross-section may be utilized in accordance with the present invention as long as it is complementary to the cross-section of the grooves 78.

The respective outer ring segments 76 may be joined to form the outer ring 72 with tie bars 86 and indexing screws 88. Alternatively, the outer ring segments 76 may remain unjoined as long as the arc that is defined by the unjoined outer ring segments 76 is equal to the arc defined by the segmented seal carrier 70. In either case, the outer ring segments 76 are formed with a generally T-shaped cross-section for engagement with the slot 74 formed in the casing 50 of the turbine 12, held in place by conventional retaining screws 90.

In order to facilitate assembly and disassembly of the compressor diaphragm according to the present invention, and to minimize the cost of producing such an assembly, spacers 92 of varying sizes are provided to properly space the vane airfoils 66 one from the other. As in the case of the tie bars 86 and the outer portions 80 of the vane airfoils 66, the inner portions 68 of each vane airfoil 66 as well as any spacers 92 between the vane airfoils 66 are locked in place as necessary with conventional retaining screws 90 or with indexing screws 88.

As explained herein above, the compressor diaphragm assembly according to the present invention thus eliminates problems of fatigue cracking caused by heat-affected zones. This also substantially reduces stress concentrations that typically build up at the inner and outer shrouds. Integrally formed vane airfoils minimizes costs associated with manufacture of such airfoils, while maximizing the quality of their production since longestablished procedures that have been utilized for rotor blade manufacture (e.g., castings, forgings, contour millings, etc.) can be applied. As is readily evident, replacement of a single damaged vane airfoil 66 is easily accomplished, and the multiplicity of interfaces between the vane airfoils 66, segmented seal carrier 70, outer ring 72, and slot 74 provide for increased mechanical damping which will minimize dynamic response.

Obviously, many modifications and variations are possible in light of the foregoing. It is, therefore, to be understood that within the scope of the appended claims, the invention may be practiced otherwise than as specifically described herein.

What we claim is:

1. In a combustion turbine having a casing, one or more slots of a first predetermined cross-section formed circumferentially within the casing at a compressor portion of the turbine, and a compressor diaphragm assembly adapted to be suspended from each of the one or more slots to provide a labyrinth seal with a plurality of compressor discs, a method of forming each compressor diaphragm assembly comprising the steps of:

providing a plurality of vane airfoils each of which have an inner shroud formed integrally with said vane airfoil, and an outer portion attached to said vane airfoil;

providing outer ring means for suspending each of the plurality of vane airfoils at a stagger angle, said outer ring means having an upper portion of complementary cross-section to the first predetermined cross-section so as to slidably engage the slots in the turbine casing, and a lower portion with a plurality of parallel slots of a second predetermined cross-section each of which are disposed to suspend said outer portion of a respective one of said plurality of vane airfoils at said stagger angle;

suspending said plurality of vane airfoils from said outer ring means, thereby disposing each said vane airfoil and its respective outer portion at said stagger angle; and providing seal carrier means for engagement with each said inner shroud, said seal carrier means having removably attached thereto at least one pair of disc-engaging seals.

2. The method according to claim 1, wherein said step providing said plurality of vane airfoils comprises, for each said vane airfoil, the steps of:

providing an airfoil portion of predetermined geometry;

providing an inner shroud formed integrally with said airfoil portion at a lower end thereof; and providing a lower portion of said inner shroud, remote from said vane airfoil, with means for engaging said carrier means, said engaging means having a third predetermined cross-section.

3. The method according to claim 2, wherein said step providing said carrier means further comprises the step of providing said carrier means with an upper portion having complementary cross-section to said third predetermined cross-section.

4. The method according to claim 2, wherein said predetermined geometry comprises a constant section.

5. The method according to claim 2, wherein said predetermined geometry comprises a variable thickness-to-chord ratio.

6. The method according to claim 1, wherein said step providing said plurality of vane airfoils further comprises, for each said vane airfoil, the step of providing said outer portion with a complementary cross-section to said second predetermined cross-section.

7. In a combustion turbine having a casing, a rotor including a plurality of rotating blades which are axially disposed along a shaft having a plurality of discs, and one or more slots of a first predetermined cross-section formed circumferentially within the casing at a compressor portion of the turbine, an improved compressor diaphragm assembly comprising in combination therewith:

a plurality of vane airfoils each of which have an inner shroud formed integrally with said vane airfoil, and an outer portion attached to said vane airfoil;

outer ring means for suspending each of the plurality of vane airfoils at a stagger angle, said outer ring means having an upper portion of complementary cross-section to the first predetermined cross-section so as to slidably engage the slots in the turbine casing, and a lower portion including a plurality of parallel slots of a second predetermined cross-section each of which are disposed to suspend said outer portion of a respective one of said plurality of vane airfoils at said stagger angle, whereby each said vane airfoil and its respective outer portion are disposed at said stagger angle; and seal carrier means for engagement with each said inner shroud, said seal carrier means having removably attached thereto at least one pair of disc-engaging seals.

8. The assembly according to claim 7, wherein each said vane airfoil comprises:

an airfoil portion of predetermined geometry; and an inner shroud formed integrally with said airfoil portion at a lower end thereof, a lower portion of said inner shroud, remote from said vane airfoil, including means for engaging said carrier means, said engaging means having a third predetermined cross-section..

9. The assembly according to claim 8, wherein said carrier means further comprises an upper portion having complementary cross-section to said third predetermined cross-section.

10. The assembly according to claim 8, wherein said predetermined geometry comprises a constant section.

11. The assembly according to claim 8, wherein said predetermined geometry comprises a variable thickness-to-chord ratio.

12. The assembly according to claim 7, wherein said outer portion of each said vane airfoil comprises a complementary cross-section to said second predetermined cross-section.

13. The assembly according to claim 7, wherein said outer ring means comprises a plurality of segments.

14. The assembly according to claim 13, further comprising means for joining adjacent pairs of said segments.

15. The assembly according to claim 7, wherein said carrier means comprises a plurality of segments.

16. The assembly according to claim 7, further comprising means for locking said outer ring means within a respective slot, and means for locking said carrier means to said inner shrouds.

17. A compressor diaphragm assembly, comprising:

a casing including a plurality of slots formed therein, each said slot having a first predetermined cross-section;

a rotor including a plurality of rows of rotating blades, each said row being axially disposed along a shaft, and a plurality of discs between adjacent rows; and a plurality of rows of stationary blades each row of which intersperses adjacent rows of said rotating blades, each said row of stationary blades comprising:

a plurality of vane airfoils each of which have an inner shroud formed integrally with said vane airfoil, and an outer portion attached to said vane airfoil;

outer ring means for suspending each of the plurality of vane airfoils at a stagger angle, said outer ring means having an upper portion of complementary cross-section to the first predetermined cross-section so as to slidably engage the slots in the casing, and a lower portion including a plurality of parallel slots of a second predetermined cross-section each of which are disposed to suspend said outer portion of a respective one of said plurality of vane airfoils at said stagger angle, whereby each said vane airfoil and its respective outer portion are disposed at said stagger angle; and seal carrier means for engagement with each said inner shroud, said seal carrier means having removably attached thereto at least one pair of disc-engaging seals.

18. The assembly according to claim 17, wherein each said vane airfoil comprises:

an airfoil portion of predetermined geometry; and an inner shroud formed integrally with said airfoil portion at a lower end thereof, a lower portion of said inner shroud, remote from said vane airfoil, including means for engaging said carrier means, said engaging means having a third predetermined cross-section.

19. The assembly according to claim 18, wherein said carrier means further comprises an upper portion having complementary cross-section to said third predetermined cross-section.

20. The assembly according to claim 18, wherein said predetermined geometry comprises a constant section.

21. The assembly according to claim 18, wherein said predetermined geometry comprises a variable thickness-to-chord ratio.

22. The assembly according to claim 17, wherein each said outer portion of each said vane airfoil comprises a complementary cross-section to said second predetermined cross-section.

23. The assembly according to claim 17, wherein said outer ring means comprises a plurality of segments.

24. The assembly according to claim 23, further comprising means for joining adjacent pairs of said segments.

25. The assembly according to claim 24, wherein said joining means comprises a tie bar and a pair of screws inserted through the tie bar into said segments.

26. The assembly according to claim 17, wherein said carrier means comprises a plurality of segments.

27. The assembly according to claim 17, further comprising means for locking said outer ring means within a respective slot, and means for locking said carrier means to said inner shrouds.

28. In a combustion turbine having a casing, a rotor including a plurality of rotating blades which are axially disposed along a shaft having a plurality of discs, and one or more slots of a first predetermined cross-section formed circumferentially within the casing at a compressor portion of the turbine, an improved compressor diaphragm assembly comprising in combination therewith:

a plurality of vane airfoils each of which have an inner shroud formed integrally therewith;

outer ring means for suspending each of the plurality of vane airfoils at a stagger angle, said outer ring means having an upper portion of complementary cross-section to the first predetermined cross-section so as to slidably engage the slots in the turbine casing, whereby each said vane airfoil and its respective outer portion are disposed at said stagger angle and wherein said outer ring means comprises a plurality of segments;

means for joining adjacent pairs of said segments; and carrier means for engagement with each said inner shroud, said carrier means including at least one pair of disc-engaging seals.

29. A compressor diaphragm assembly, comprising:

a casing including a plurality of slots formed therein, each said slot having a first predetermined cross-section;

a rotor including a plurality of rows of rotating blades, each said row being axially disposed along a shaft, and a plurality of discs between adjacent rows; and a plurality of rows of stationary blades each row of which intersperses adjacent rows of said rotating blades, each said row of stationary blades comprising:

a plurality of vane airfoils each of which have an inner shroud formed integrally therewith;

outer ring means for suspending each of the plurality of vane airfoils at a stagger angle, said outer ring means having an upper portion of complementary cross-section to the first predetermined cross-section so as to slidably engage the slots in the casing, whereby each said vane airfoil and its respective outer portion are disposed at said stagger angle and wherein said outer ring means comprises a plurality of segments;

means for joining adjacent pairs of said segments; and carrier means for engagement with each said inner shroud, said carrier means including at least one pair of disc-engaging seals.

30. The assembly according to claim 29, wherein said joining means comprises a tie bar and a pair of screws inserted through the tie bar into said segments.

* * * * *